US008245625B2

(12) United States Patent
Winge

(10) Patent No.: US 8,245,625 B2
(45) Date of Patent: Aug. 21, 2012

(54) GAS PRESSURE MECHANISM IN GAS-OPERATED FIREARM

(76) Inventor: Michael L. Winge, Boonville, IN (US)

( * ) Notice: Subject to any disclaimer, the term of this patent is extended or adjusted under 35 U.S.C. 154(b) by 348 days.

(21) Appl. No.: 12/459,075

(22) Filed: Jun. 26, 2009

(65) Prior Publication Data

US 2010/0024636 A1 Feb. 4, 2010

(51) Int. Cl.
*F41A 5/18* (2006.01)

(52) U.S. Cl. ..... 89/193; 89/191.01; 89/191.02

(58) Field of Classification Search ..... 89/179, 89/191.01, 191.02, 192, 193, 194
See application file for complete search history.

(56) References Cited

U.S. PATENT DOCUMENTS

| | | | | | |
|---|---|---|---|---|---|
| 2,482,880 | A | * | 9/1949 | Sefried | 89/193 |
| 2,814,972 | A | * | 12/1957 | Simmons, Jr. | 89/193 |
| 2,845,008 | A | * | 7/1958 | Atwood, Jr. | 89/193 |
| 2,865,256 | A | * | 12/1958 | Roger | 89/191.02 |
| 2,870,685 | A | * | 1/1959 | Harvey | 89/193 |
| 2,987,968 | A | * | 6/1961 | Janson | 89/193 |
| 3,200,710 | A | * | 8/1965 | Kelly et al. | 89/191.02 |
| 3,568,564 | A | * | 3/1971 | Badali | 89/191.02 |
| 3,592,101 | A | * | 7/1971 | Vartanian et al. | 89/193 |
| 3,657,960 | A | * | 4/1972 | Badali | 89/191.02 |
| 3,765,302 | A | * | 10/1973 | Browning | 89/193 |
| 3,779,131 | A | * | 12/1973 | Kawamura | 89/191.02 |
| 3,848,511 | A | * | 11/1974 | Zanoni | 89/191.02 |
| 3,869,961 | A | * | 3/1975 | Kawamura | 89/191.02 |
| 3,968,727 | A | * | 7/1976 | Hyytinen | 89/191.02 |
| 3,982,468 | A | * | 9/1976 | Browning | 89/193 |
| 4,102,243 | A | * | 7/1978 | Jennie | 89/193 |
| 4,125,054 | A | * | 11/1978 | Jennie | 89/193 |
| 4,174,654 | A | * | 11/1979 | Liedke | 89/191.02 |
| 4,389,920 | A | * | 6/1983 | Dufour, Sr. | 89/190 |
| 4,414,880 | A | * | 11/1983 | Throner | 89/193 |
| 4,503,632 | A | * | 3/1985 | Cuevas | 42/1.06 |
| 4,505,183 | A | * | 3/1985 | Grehl | 89/191.02 |
| 4,563,937 | A | * | 1/1986 | White | 89/185 |
| 4,619,184 | A | * | 10/1986 | Shalev | 89/185 |
| 4,702,146 | A | * | 10/1987 | Ikeda et al. | 89/193 |
| 5,388,500 | A | * | 2/1995 | Petrovich | 89/194 |
| 5,404,790 | A | * | 4/1995 | Averbukh | 89/193 |
| 5,429,034 | A | * | 7/1995 | Badali et al. | 89/193 |
| 5,959,234 | A | * | 9/1999 | Scaramucci et al. | 89/193 |
| 6,374,720 | B1 | * | 4/2002 | Tedde | 89/193 |
| 6,418,833 | B1 | * | 7/2002 | Hajjar | 89/199 |
| 6,606,934 | B1 | * | 8/2003 | Rock et al. | 89/192 |
| 6,619,592 | B2 | * | 9/2003 | Vignaroli et al. | 89/191.01 |
| 7,461,581 | B2 | * | 12/2008 | Leitner-Wise | 89/191.01 |
| 7,832,326 | B1 | * | 11/2010 | Barrett | 89/191.01 |

(Continued)

*Primary Examiner* — Michael Carone
*Assistant Examiner* — Joshua Freeman
(74) *Attorney, Agent, or Firm* — Gary K. Price

(57) ABSTRACT

A gas pressure mechanism that receives and supplies gas pressure to a semi or automatic shotgun during the shotgun's reloading operation. The gas pressure mechanism includes twin body members having a front cylinder in fluid communication with a rear cylinder. Each rear cylinder includes a rear gas port disposed in communication with the interior of the shotgun barrel such that gases of combustion is bled through the rear gas ports from the interior of the barrel to the interior of the rear cylinders. Similarly, each front cylinder includes a front gas port disposed in communication with the interior of the shotgun barrel at a location to effectively recoil and counter-recoil the shotgun's piston or breech bolt to its rear most position. The rear cylinders, are situated immediately in front of the shotgun's shell chamber such that the rear gas ports capture and receive the gas pressure developed immediately behind the shell load as it travels through the barrel after firing.

14 Claims, 5 Drawing Sheets

U.S. PATENT DOCUMENTS * cited by examiner

| | | | | |
|---|---|---|---|---|
| 7,946,214 | B2 * | 5/2011 | Stone | 89/193 |
| 2001/0054350 | A1 * | 12/2001 | Beretta | 89/191.02 |
| 2002/0139241 | A1 * | 10/2002 | Butler | 89/191.01 |
| 2010/0071541 | A1 * | 3/2010 | Barrett | 89/191.01 |
| 2010/0282065 | A1 * | 11/2010 | Stone | 89/191.02 |

GAS PRESSURE MECHANISM IN GAS-OPERATED FIREARM

CROSS REFERENCES TO RELATED APPLICATIONS

U.S. Provisional Application for Patent No. 61/137,291, filed Jul. 29, 2008, with title "Gas Pressure Mechanism in Gas-Operated Firearm" which is hereby incorporated by reference. Applicant claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates generally to gas-operated automatic or semi-automatic loading firearms, and more particularly to a gas pressure mechanism in an automatic or semi-automatic loading shotgun.

2. Brief Description of Prior Art

In a typical automatic or semi-automatic shotgun (for purposes herein, reference to "shotgun" shall mean automatic or semi-automatic shotgun), when a shotshell is fired, gas under great pressure is generated within the gun bore. A portion of this gas is tapped through a gas port and into a gas-operated mechanism that is generally parallel to and below the gun barrel. This mechanism is driven by the gas to actuate a breech bolt which undergoes a recoiling motion while compressing a recoil spring, which thereafter forces the breech bolt to undergo a counter-recoiling motion to return the breech bolt to its initial state and close the breech of the chamber. During its recoiling and counter-recoiling motions, the breech bolt carries out the actions of ejecting the empty case of the shotshell which has just been fired, loading the succeeding shotshell into the chamber, and cocking the firing mechanism in preparation for the succeeding firing. The above described cycle of operation in a gas-operated shotgun is widely known.

In the relevant prior art, the gas pressure is comparatively low, particularly in the front region of the barrel. As such, the gas pressure generated in the prior art gas-oriented semi or auto loading shotgun is too low for consistent, efficient reloading operation, resulting in auto-reload failure. Further, the reload operation of the relevant prior art is particularly sensitive to the type of ammunition used.

As will be seen from the subsequent description, the preferred embodiments of the present invention overcome disadvantages of the prior art. In this regard, the present invention discloses a gas pressure mechanism that supplies gas pressure to the shotgun's reloading mechanism faster than the prior art and in a controlled, consistent manner.

SUMMARY OF THE INVENTION

The preferred embodiment of the present invention, a gas pressure mechanism, includes twin body members each of which is tightly nestled against the assembled barrel of the shotgun. The twin members each include a front cylinder disposed in spaced parallel relation to each other and are fixed to a front mounting bracket that is fastened rigidly to the barrel, for example, by bracing. Likewise, the twin body members each further include rear cylinders that are disposed in spaced parallel relation to each other and are fixed to a rear mounting bracket that is fastened rigidly to the barrel, for example, by bracing. Each twin body member further includes a hollow tube portion wherein the tube portion is sandwiched between and in fluid communication with the respective front cylinder and rear cylinder, defining a path between the front cylinder and rear cylinder.

Each rear cylinder includes a rear gas port disposed in communication with the interior of the shotgun barrel such that gases of combustion is bled through the rear gas ports from the interior of the barrel to the interior of the rear cylinders. Similarly, each front cylinder includes a front gas port disposed in communication with the interior of the shotgun barrel at a location to effectively recoil and counter-recoil the shotgun's piston or breech bolt to its rear most position. The rear gas ports described are each situated immediately adjacent the shotgun's shell chamber in the rear region of the shotgun barrel such that the rear gas ports capture and receive the gas pressure developing immediately behind the shell load as it travels through the barrel after firing.

Each front cylinder further includes a pressure release hole as a means to control the amount of pressure to the reloading system of the shotgun and means of releasing excess gas pressure from the mechanism not necessary to drive or recoil the piston to its rear most position. An adjustment cap member having notches and a stop selectively and releasably adjusts the cap in relation to the front gas ports in order to control the volume of gas pressure that enters and is released through the front gas ports.

DESCRIPTION OF THE PREFERRED EMBODIMENT

Figure 1:
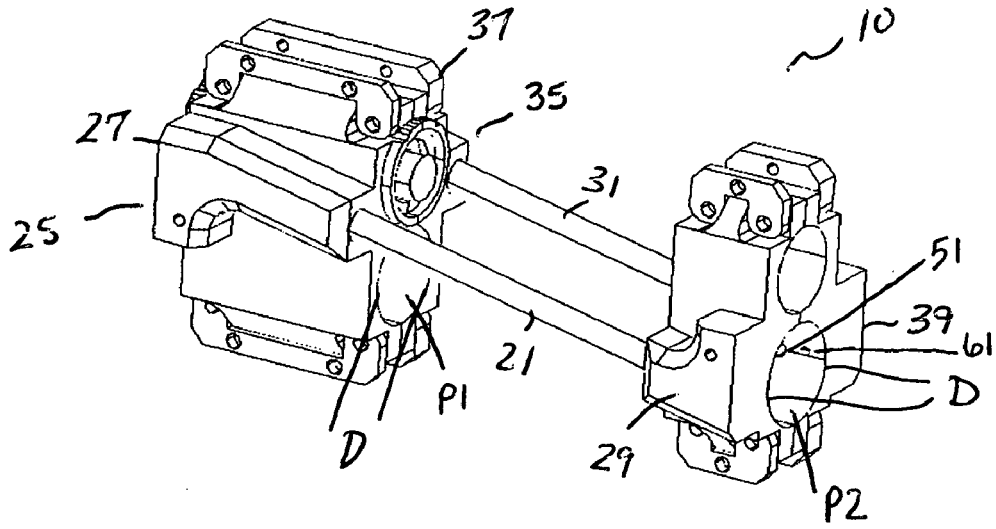
FIG. 1 is a perspective view of the present invention, a gas pressure mechanism in gas-operated firearms.

The device of the present invention is directed to a gas pressure mechanism that is used in association with a gas-operated shotgun. Unlike the prior art, the gas pressure mechanism of the present invention is situate adjacent the shotgun's shell chamber in a rear region of the shotgun barrel for capturing gas pressure developed immediately behind the shell load after firing. As a result, the gas pressure generated in the rear region of the barrel is immediately captured resulting in a more consistent, efficient reloading operation, and further resulting in significantly less auto-reload failure. Further, the reload operation of the present invention is adjustable in order to gauge the resulting gas pressure to the type of ammunition used. As will be described, the gas pressure mechanism as disclosed consists of components configured and correlated with respect to each other so as to attain the desired objective.

From the outset, it should be understood that the present invention relates solely to a mechanism that receives and supplies gas pressure to the shotgun's reloading mechanism. The present invention does not alter the reloading process of a prior art gas-operated shotgun. In this regard, when a round is fired, gas pressure is developed behind the shell load as it travels through the barrel. Gases of combustion are immediately bled through gas ports connecting the interior of the barrel to the interior of the gas pressure mechanism of the present invention. The gas pressure developed results in recoiling and counter-recoiling motions of the shotgun's piston or breech bolt which carries out the actions of ejecting the empty case of the shotshell which has just been fired, loading the succeeding shotshell in the chamber, and cocking the firing mechanism in preparation for the succeeding firing. Again, the above described cycle of operation in a gas-operated semi and auto-loading shotgun is widely known and not altered by the present invention.

The present invention discloses a gas pressure mechanism that is disposed adjacent the shotgun's shell chamber in the rear region of the shotgun barrel. As a direct result of its positioning on the shotgun, the mechanism is able to capture the gas pressure developed immediately behind the shell load generated during the shotgun's firing operation. The mechanism then supplies the gas pressure to the shotgun's reloading mechanism.

FIGS. 1-5 illustrate a preferred embodiment of a gas pressure mechanism made in accordance with the present invention. The gas pressure mechanism generally indicated as numeral 10 initiates actuation of a piston or breech-bolt mechanism 100 (FIGS. 2 and 3) through the reloading cycle described above. Preferably, the system 10 includes twin gas-receiving/supplying body members 25 and 35 tightly nestled against the assembled barrel of the shotgun (not shown). Each of the twin body members 25, 35 comprise of front cylinders 27, 37 disposed in spaced parallel relation to each other and are fixed to a front mounting bracket that is fastened rigidly to the barrel, for example, by bracing. Likewise, the gas-receiving body members 25, 35 each further include rear cylinders 29, 39 that are similarly disposed in spaced parallel relation to each other and are fixed to a rear mounting bracket that is fastened rigidly to the barrel, for example, by bracing.

As will be understood from the description herein, the twin body members 25, 35 are symmetrically constructed with pairs of elements on opposite sides of the shotgun barrel. As such, only the elements found on one side of the gas pressure mechanism 10 may at times be shown and described. It should be understood that the other set of elements are identical to those described with the exception that the other set of elements are mirror images of the first set of elements described. Further, while the preferred embodiment includes twin body members, it should be understood that a single body member having the elements found on one side of the gas pressure mechanism 10 is within the scope of the present invention.

As will be noted from the drawings, the front cylinders 27, 37 and rear cylinders 29, 39 each define a front and rear passage P1, P2, respectively, that have an outside diameter "D" (see FIG. 1) selectively sized to conform to the diameter of the shotgun barrel.

Each twin body member 25, 35 further includes hollow tube portions 21, 31 such that the tube portion 21 is sandwiched between and in fluid communication with the front cylinder 27 and rear cylinder 29, and the tube portion 31 is sandwiched between and in fluid communication with the front cylinder 37 and the rear cylinder 39. In this regard, the hollow tube portion 21 defines a fluid path between front cylinder 27 and rear cylinder 29, and the tube portion 31 defines a fluid path between front cylinder 37 and rear cylinder 39.

As will be described, the rear cylinders 29, 39 each include at least one rear gas port 51, 61 (FIGS. 1-4), respectively, which rear gas ports are each in communication with the interior of the shotgun barrel and fluid communication with the interior of the respective rear cylinders such that gases of combustion is bled through the rear gas ports 51, 61 from the interior of the barrel to the interior of the rear cylinders 29, 39. Likewise, the front cylinders 27, 37 each include at least one front gas port 53 (not shown), 63 (FIG. 4), respectively, which front gas ports are each in communication with the interior of the shotgun barrel at a location to effectively recoil and counter-recoil the shotgun's piston or breech bolt 100 as will be further described. It should be noted that the rear gas ports 51, 61 are situated immediately adjacent the shotgun's shell chamber in the rear region of the shotgun barrel such that the rear gas ports 51, 61 capture and receives the gas pressure developed immediately behind the shell load as it travels through the barrel after firing.

Figure 2:
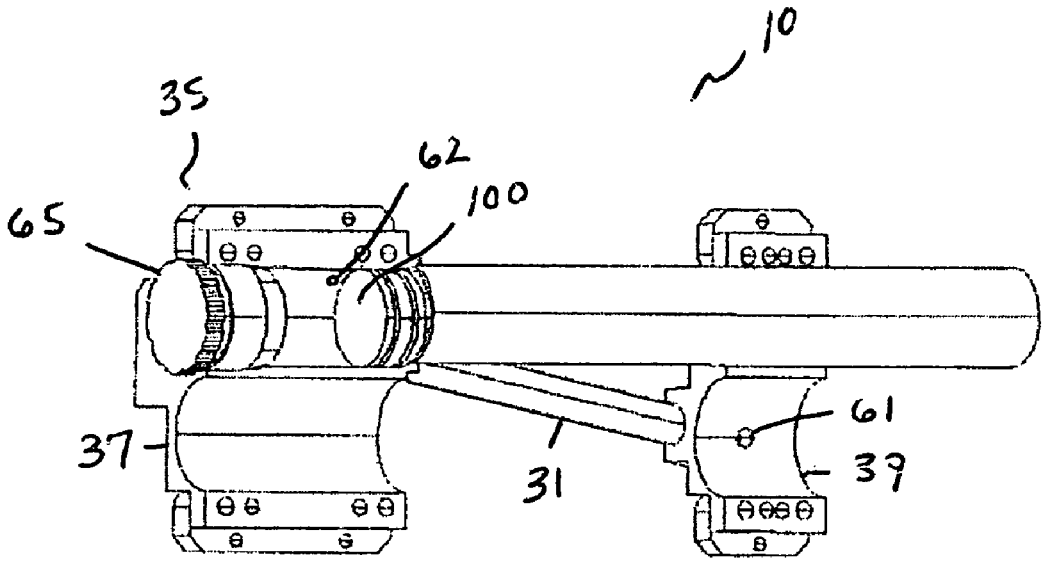
FIG. 2 is a sectional view of the device of FIG. 1 with the breech bolt in its rear most or initial position.

The front cylinders 27, 37 each further include at least one pressure release hole 52 (not shown), 62 (FIG. 2). Again, pressure release hole 52, disposed on front cylinder 27, is identical to the pressure relief hole 62 shown and described, with the exception that the release hole 52 of the front cylinder 27 is a mirror image of the release hole 62 of front cylinder 37 described. The release holes 52, 62 serve as a means of releasing any excess gas pressure in the mechanism 10 that is not required to drive or recoil the piston 100 to its rear most position.

Figure 4:
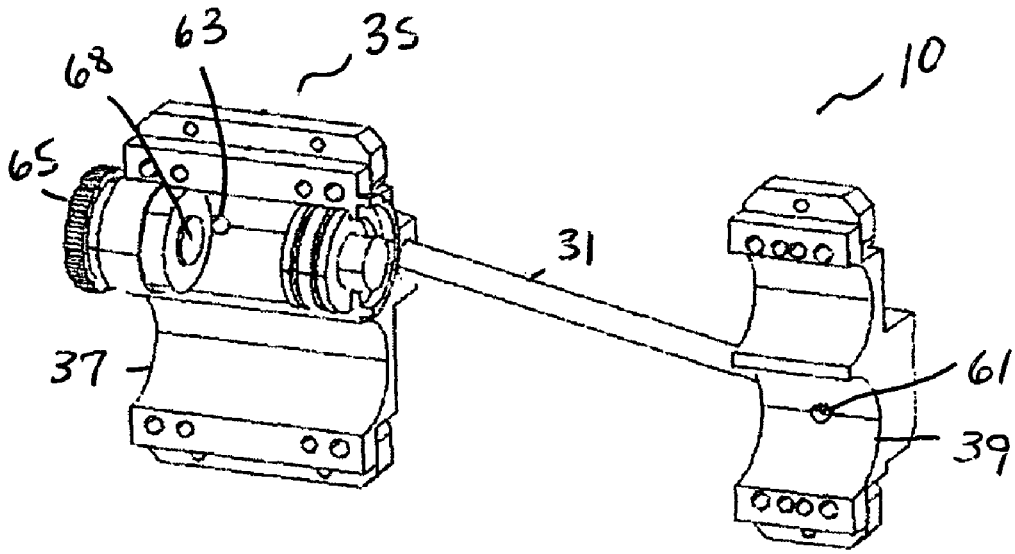
FIG. 4 is a sectional view of the device of FIG. 1.
Figure 5:
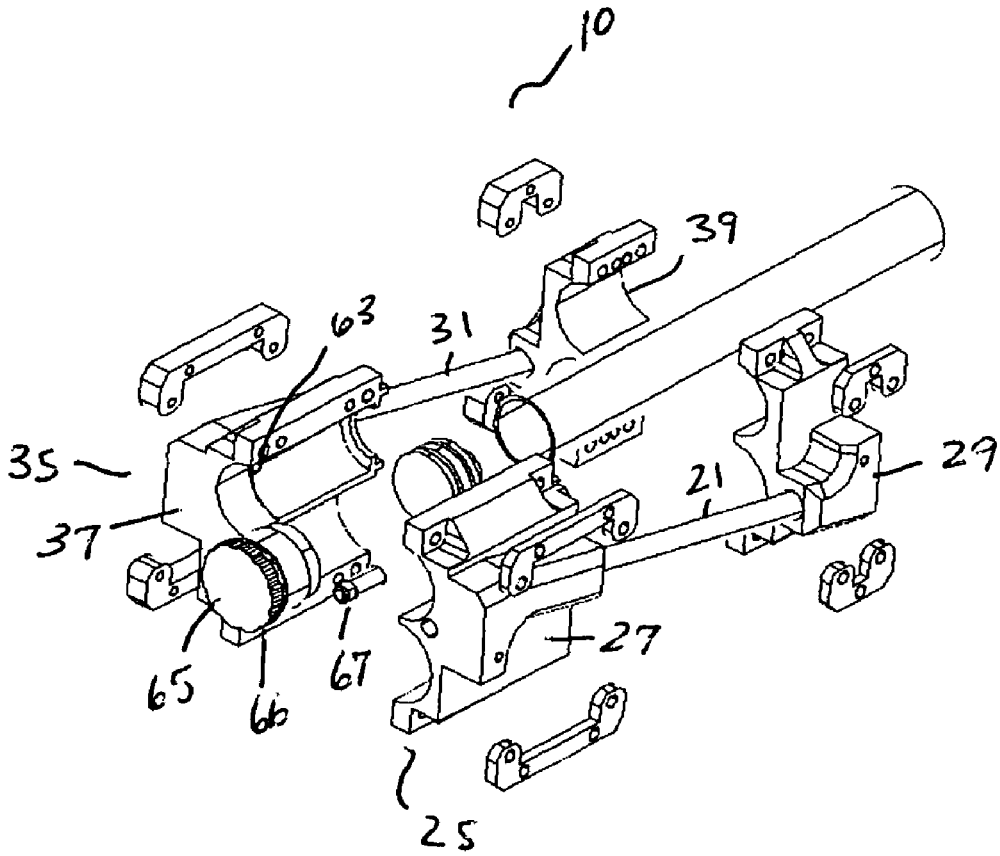
FIG. 5 is an exploded view of the device of FIG. 1.

The gas pressure mechanism 10 further includes an adjustment cap member 65 that includes notches 66 and a stop 67 (FIG. 5) for selectively and releasably adjusting the cap 65. The cap member 65 is adjustable in relation to the front gas ports 53, 63 in order to control the volume of gas pressure that enters and is released through the front gas ports thereby controlling the gas pressure entering the shotgun's barrel as previously described. For example, adjustment cap 65 can be selectively positioned such that the front gas ports 53, 63 are fully opened as shown in FIG. 4, or can be positioned so that an end 68 of the cap member 65 partially covers the front gas ports 53, 63 thereby decreasing the flow of gas pressure into the shotgun barrel.

The gas pressure mechanism of the present invention operates as follows. When a round is fired, gas pressure is developed behind the load as it travels through the barrel. The gas pressure developed immediately passes from the interior of the shotgun barrel through the rear gas ports 51, 61 into the rear cylinders 29, 39, respectively. There, the gas pressure passes from the rear cylinders 29, 39 along the path through the tube portions 21, 31 into the front cylinders 27, 37. The gas pressure then passes from the front cylinders 27, 37 through the front gas ports 53, 63 into the interior of the shotgun barrel. The gas pressure developed results in recoiling and counter-recoiling motion of the shotgun's piston or breech bolt 100 to its rear most position which carries out the actions of ejecting the empty case of the shot shell which has just been fired, loading the succeeding shot shell in the chamber, and cocking the firing mechanism in preparation for the succeeding firing.

Figure 3:
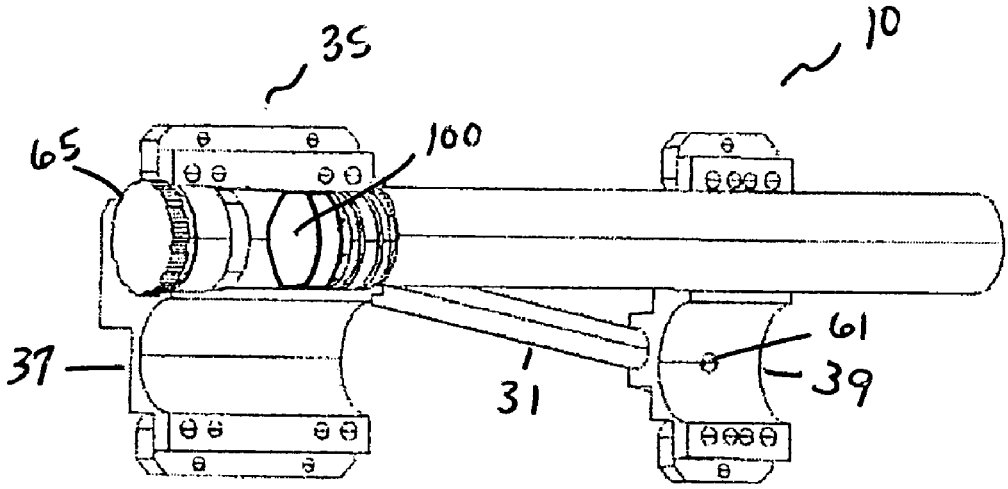
FIG. 3 is a sectional view of the device of FIG. 1 with the breech bolt in its forward most position.

It should be understood that when the piston 100 is in its forward most position as shown in FIG. 3, the piston blocks gas pressure from releasing through the release holes 52, 62 causing the gas pressure to pass through the front ports 53, 63 into the interior of the shotgun barrel. When the piston 100 returns to the rear most position as shown in FIG. 2, release holes 52, 62 are then exposed and any excess gas pressure can release through holes 52, 62.

While the rearward stroke of the piston 100 is limited, the initial impact and force developed by the compressed gas from the mechanism 10 as described imparts sufficient energy to drive it to its rear most position shown in FIG. 2, resulting in a more consistent, efficient reloading operation, and further resulting in significantly less auto-reload failure. This consistency is due to the mechanism 10 and more particularly, the rear cylinders 29, 39 situated adjacent the shotgun's shell chamber in the rear region of the shotgun barrel. Again, during this rearward stroke, the spent shell is ejected from the shotgun's receiver and a new shell is raised into position in front of the breech bolt 100 so that when the bolt 100 is driven forward again, the new shell is fed into the chamber.

Although the above description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A gas pressure mechanism that receives and supplies gas pressure to an auto-loading firearm during the firearm's reloading operation, said gas pressure mechanism comprising:

a pair of twin body members symmetrically adapted to nestle against a firearm's barrel, each twin body member comprising a front cylinder in fluid communication with a rear cylinder;

wherein each of said rear cylinders include a rear gas port for fluid communication with an interior of the barrel such that gases of combustion is bled through each of said rear gas ports from the interior of the barrel to the interior of the rear cylinders, wherein said rear gas ports are situated for fluid communication with the front of the firearm's shell chamber in a rear region of the barrel in order to capture and receive the gas pressure developed immediately behind a shell load as it travels through the barrel after firing and deliver the gas pressure forward to the front cylinder, wherein each of said front cylinders include a front gas port for fluid communication with the interior of the shotgun barrel such that the gas pressure delivered from said rear cylinder passes through the front gas ports and is received in the front cylinders to recoil and counter-recoil the shotgun's piston to its rear most position, said front cylinder further includes a pressure release hole as a means of releasing excess gas pressure from the mechanism, said pressure release hole is covered by said piston until said piston is in its rear most position, an adjustment cap member having a stop, wherein said cap member selectively adjusts a cap end in a rearward or forward direction to selectively partially cover said front gas ports in order to control the volume of gas pressure that enters and is released through the front gas ports and into said front cylinders.

2. The gas pressure mechanism as recited in claim 1, wherein said twin body members are symmetrically constructed in order to locate on opposite sides of said firearm's barrel.

3. The gas pressure mechanism as recited in claim 2, wherein said front cylinders are disposed in spaced parallel relation to each other and are fixed to a front mounting bracket that is adapted to fasten rigidly to the barrel.

4. The gas pressure mechanism as recited in claim 3, wherein said rear cylinders are disposed in spaced parallel relation to each other and are fixed to a rear mounting bracket that is adapted to fasten rigidly to the barrel.

5. The gas pressure mechanism as recited in claim 4, wherein said front cylinders define a front passage and said rear cylinder define a rear passage, said front and rear passages having an outside diameter adapted to conform to the diameter of a shotgun's barrel.

6. A gas pressure mechanism that receives and supplies gas pressure to an auto-loading shotgun during the shotgun's reloading operation, said gas pressure mechanism comprising:

at least one body member adapted to press against a shotgun's barrel, said at least one body member comprising a front cylinder in fluid communication with a rear cylinder;

wherein said rear cylinder includes at least one rear gas bore for fluid communication with an interior of the shotgun barrel such that gases of combustion is bled through said at least one rear gas bore from the interior of the barrel to the interior of the rear cylinder, wherein said at least one rear gas bore for fluid communication with the shotgun's shell chamber in a rear region of the shotgun's barrel in order to captures and receives the gas pressure developed immediately behind a shell load as it travels through the barrel after firing and deliver the gas pressure forward to the front cylinder, wherein said front cylinder includes at least one front gas bore for fluid communication with the interior of the shotgun barrel such that the gas pressure delivered passes through the at least one front gas bore into the interior of the front cylinder in order to recoil and counter-recoil the shotgun's piston to its rear most position, said front cylinder further includes at least one pressure release hole as a means of releasing excess gas pressure from the gas pressure mechanism, an adjustment cap member having notches and a stop, wherein said cap member selectively and releasably adjusts a cap end in a rearward or forward direction to selectively partially cover said at least one front gas bore.

7. The gas pressure mechanism as recited in claim 6, wherein said front cylinder is fixed to a front mounting bracket that is adapted to fasten rigidly to the shotgun barrel.

8. The gas pressure mechanism as recited in claim 7, wherein said rear cylinder is fixed to a rear mounting bracket that is adapted to fasten rigidly to the shotgun's barrel.

9. A gas pressure mechanism that receives and supplies gas pressure to an auto-loading shotgun during the shotgun's reloading operation, said gas pressure mechanism comprising:

at least one body member constructed for attaching to a shotgun's barrel, said at least one body member comprising a front cylinder in fluid communication with a rear cylinder, said at least one body member fixed to a bracket that is adapted to mount to the shotgun barrel, wherein said rear cylinder includes at least one rear gas bore for fluid communication with an interior of the shotgun barrel, said at least one rear gas bore is situated for fluid communication with the shotgun's shell chamber in a rear region of the shotgun's barrel such that the at least one rear gas bore captures and receives the gas pressure developed immediately behind a shell load as it travels through the barrel after firing and delivers the gas pressure forward to the front cylinder, wherein said front cylinder includes at least one front gas bore for fluid communication with the interior of the shotgun barrel such that the delivered gas pressure passes through the at least one front gas bore and received in the interior of the front cylinder, said front cylinder further includes at least one pressure release hole as a means of releasing excess gas pressure from the mechanism, and an adjustment cap on said front cylinder that includes a cap end, wherein adjusting said cap end in a rearward or forward direction to selectively partially cover said front gas bore to adjust travel of said piston.

10. The gas pressure mechanism as recited in claim 9, wherein said adjustment cap member selectively adjusts said cap end relative to said at least one front gas bore.

11. The gas pressure mechanism as recited in claim 10, wherein said cap end selectively controls the volume of gas pressure that can enter and release through said at least one front gas bore.

12. The gas pressure mechanism as recited in claim 11, wherein said cap member further includes a plurality of notches that engage a stop to selectively control positioning said cap end.

13. The gas pressure mechanism as recited in claim 9, further including a channel disposed between and in fluid communication with said front and rear cylinders.

14. The gas pressure mechanism as recited in claim 13, wherein said channel defines a fluid path between said front and rear cylinders.

* * * * *